US005265070A

United States Patent [19]

Minowa

[11] Patent Number: 5,265,070

[45] Date of Patent: Nov. 23, 1993

[54] RECEIVING DEVICE WITH TIMEKEEPING FUNCTION

[75] Inventor: Yoshiki Minowa, Suwa, Japan

[73] Assignee: Seiko Epson Corporation, Tokyo, Japan

[21] Appl. No.: 713,251

[22] Filed: Jun. 7, 1991

Related U.S. Application Data

[63] Continuation-in-part of Ser. No. 609,679, Nov. 6, 1990.

[30] Foreign Application Priority Data

| | | | |
|---|---|---|---|
| Nov. 8, 1989 | [JP] | Japan | 1-290514 |
| Jun. 12, 1990 | [JP] | Japan | 2-153373 |
| Sep. 12, 1990 | [JP] | Japan | 2-241997 |

[51] Int. Cl.[5] ..... G04C 11/02

[52] U.S. Cl. ..... 368/47

[58] Field of Search ..... 368/47-61

[56] References Cited

U.S. PATENT DOCUMENTS

| | | | |
|---|---|---|---|
| 4,204,398 | 5/1980 | Lemelson | 368/47 |
| 4,440,501 | 4/1984 | Schulz | 368/47 |
| 4,525,685 | 6/1985 | Hesselberth et al. | 368/47 |
| 4,569,598 | 2/1986 | Jacobs | 368/47 |
| 4,582,434 | 4/1986 | Plangger et al. | 368/47 |
| 4,650,344 | 3/1987 | Allgaier | 368/47 |
| 4,823,328 | 4/1989 | Conklin et al. | 368/47 |

FOREIGN PATENT DOCUMENTS

| | | |
|---|---|---|
| 0305200 | 1/1989 | European Pat. Off. . |
| 2715096 | 12/1978 | Fed. Rep. of Germany . |
| 093082 | 7/1980 | Japan . |
| 110081 | 5/1986 | Japan . |
| 8603645 | 6/1986 | World Int. Prop. O. . |

OTHER PUBLICATIONS

Entwicklung und Technischer Stand Funkgesteuerter Gross-und Armbankuhren by Die Junghans Mega 1 (catalog), 1990.

*Primary Examiner*—Bernard Roskoski

*Attorney, Agent, or Firm*—Blum Kaplan

[57] ABSTRACT

A receiver with timekeeping function for maintaining and displaying at least two different times of day which are each updated based on an external signal. The receiver includes first timekeeping circuitry for generating first time related information and second timekeeping circuitry for generating second time related information. Each time of day is represented by hours, minutes and seconds. The second time of day is further adjusted based on the adjustments made to the first time of day to insure that the second time of day does not gain or lose a minute of time.

46 Claims, 3 Drawing Sheets

RECEIVING DEVICE WITH TIMEKEEPING FUNCTION

CROSS-REFERENCE TO RELATED APPLICATION

This application is a continuation-in-part of U.S. patent application Ser. No. 07/609,679, filed Nov. 6, 1990, currently pending.

BACKGROUND OF THE INVENTION

This invention relates generally to a receiving device with timekeeping function and, in particular, to a wireless receiver for receiving time related information carried by electromagnetic waves for updating at least two different times of day displayed by the receiver.

A conventional receiver for receiving a selected signal having a manually adjustable timekeeping function is well known in the art. Since the timekeeping function does not always reflect the correct time of day, adjustment thereto is required on occasion. The frequency of adjustment is based in part, on the precision of the timekeeping mechanism within the receiver.

It is anticipated that services will be provided in the near future for transmitting electromagnetic waves containing only time related information at specified points in time. Such time related information would be used by the receiver for adjusting the internally measured time to update the same in providing the correct time of day.

Conventional selective signal wireless receivers having timekeeping functions are capable of processing time related information transmitted by the service associated with a single time zone. When the timekeeping function of the receiver includes the times of day for different time zones, the timekeeping function must be manually adjusted in updating the same to provide the correct times of day for those time zones other than the time zone in which the receiver is presently located.

When the receiver is moved to a new time zone, the receiver automatically adjusts the internally measured time based on the new time zone. Since the receiver automatically adjusts the internally measured time based on the time related information broadcasted within and reflecting only the new time zone, the accuracy of the previous (old) time zone is not maintained. Manual adjustment to the receiver to maintain the accuracy of the timekeeping function with respect to the old time zone is required. As a practical matter, the receiver cannot be manually adjusted frequently enough to provide a highly accurate display for the time of day in more than one time zone.

The conventional receiver also cannot be adjusted to other than the correct time of day for the time zone in which the receiver is presently located. In other words, a conventional receiver cannot be set (advanced) ahead of the correct time of day.

It is therefore desirable to provide a selected signal wireless receiving device with timekeeping function in which the time of day for more than one time zone can be accurately and automatically maintained. The timekeeping function should also be capable of adjustment for displaying a time of day which has been advanced by a preset period of time beyond the correct time of day.

SUMMARY OF THE INVENTION

Generally speaking, in accordance with the invention, a receiving device with timekeeping function for receiving an external signal includes first timekeeping circuitry for clocking first time related information, second timekeeping circuitry for clocking second time related information and a control unit for adjusting first time related information of the first timekeeping circuitry and for adjusting second time related information of the second timekeeping circuitry based on the external signal.

The receiving device, by updating both first timekeeping and second timekeeping circuitry based on the external signal, provides times of day for more than one time zone to be accurately maintained and adjusted as required. In addition, the second timekeeping circuitry can be used to display a time of day advanced by a preset period of time beyond the correct time.

First time related information, second time related information and external signal each include data representing hour, minutes and seconds.

The external signal is produced by a wireless transmitter. An error correction circuit facilitates accurate timekeeping of second time related information. The receiving device also includes a liquid crystal display (LCD) to selectively display one of either first time related information or second time related information.

In another aspect of the invention, the control unit determines the amount of adjustment made to first related information for purposes of adjusting second time related information based on both the degree of adjustment made to first time related information and based on first time related information following adjustment to first time related information.

This further adjustment to the second time related information insures that the minutes and seconds of the second time related information remain equal to the minutes and seconds of the first time related information after the first time related information has been adjusted. More accurate timekeeping of the second time related information results.

Accordingly, it is an object of the present invention to provide an improved wireless receiving device with timekeeping function for accurately maintaining and displaying at least two different times of day.

It is another object of the present invention to provide an improved wireless receiving device with timekeeping function which automatically adjusts each of at least two different displayed times of day based on external time related information received by the wireless receiver.

Still other objects and advantages of the invention will, in part, be obvious and will, in part, be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
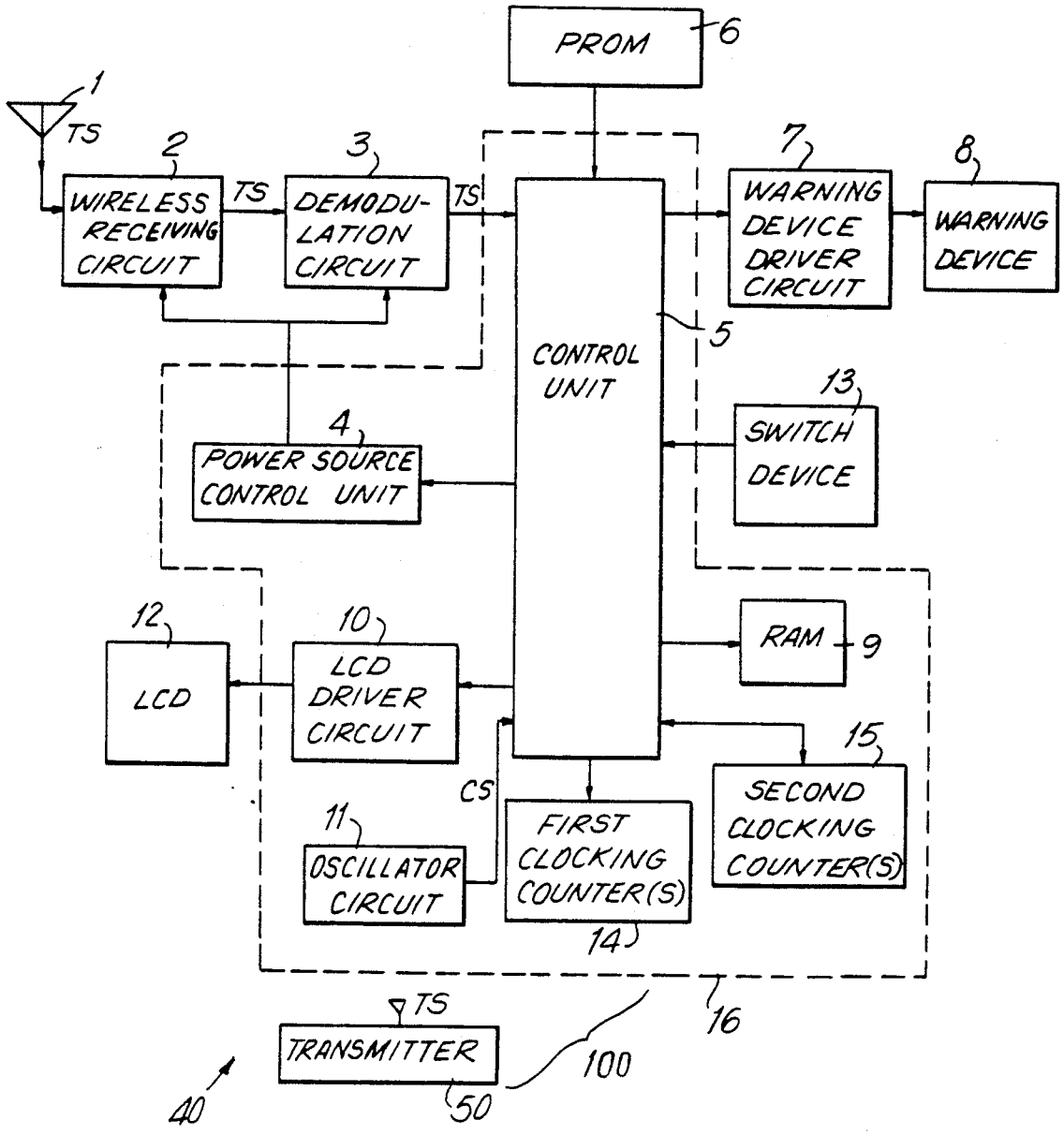
FIG. 1 is a block diagram of a selective signal wireless receiving device with timekeeping function in accordance with the invention.

Reference is first made to FIG. 1 which depicts a system 100 having a selected signal wireless receiver 40 with an electronic timekeeping function and a transmitter 50. Receiver 40 includes an antenna 1 for receiving external signals provided by transmitter 50, a wireless receiving circuit 2 and a demodulation circuit 3. The external signals include the correct time of day referred to hereinafter as the standard time information.

Receiver 40 further includes a power source control unit 4 for controlling the power to wireless receiving circuit 2 and demodulation circuit 3 and a control unit 5 for controlling power source control unit 4. A programmable read only memory (PROM) 6 of receiver 40 stores a call number associated only with receiver 40. The call number is compared by control unit 5 with the call number of incoming data received by antenna 1 (messages, standard time of day). Only data containing the particular call number is further processed by receiver 40.

A random access memory (RAM) 9 of receiver 40 stores the transmitted data (e.g. individual call number, message and standard time signals). A liquid crystal display (LCD) driver circuit 10 drives an LCD 12 of receiver 40 for displaying portions of the data (e.g. message) as well as at least two different times of day. An oscillator circuit 11 containing a crystal oscillator generates a clock signal CS used for controlling LCD driver circuit 10 and for producing at least two different time signals.

Receiver 40 also includes one or more first clocking counters 14 for counting pulses of clock signal CS and generating a signal indicative of the first time of day and one or more second clocking counters 15 for counting pulses of clock signal CS and generating signals indicative of the second time of day. For exemplary purposes only, one counter 14 and one counter 15 will be described hereinafter. Counters 14 and 15 are connected to control unit 5.

Power source control circuit 4, control unit 5, RAM 9, LCD driver circuit 10, oscillator circuit 11, first clocking counter 14 and second clocking counter 15, collectively form a control section 16.

Receiver 40 also acts as a paging device for receiving messages provided by the external signal. Control unit 5 is also operable for processing this non-time related message. Receiver 40 includes a warning device driver circuit 7, a warning device 8 (e.g. buzzer, a light emitting diode (LED) or a vibrator) for acknowledging receipt of the message and processing by control unit 5, and a switching device 13 for operating receiver 40.

An external signal containing standard time information (TS), transmitted by transmitter 50, at a predetermined radio frequency, is received by antenna 1 of receiver 40 and is supplied to wireless receiving circuit 2. The received signal is demodulated, its waveform shaped and converted to a digital signal in demodulation circuit 3. This digital signal undergoes a first error correction in demodulation circuit 3. After the error correction, the digital signal is checked by demodulation circuit 3. If it is determined that the external signal contains time information, the external signal is transmitted to control section 16.

Figure 2:
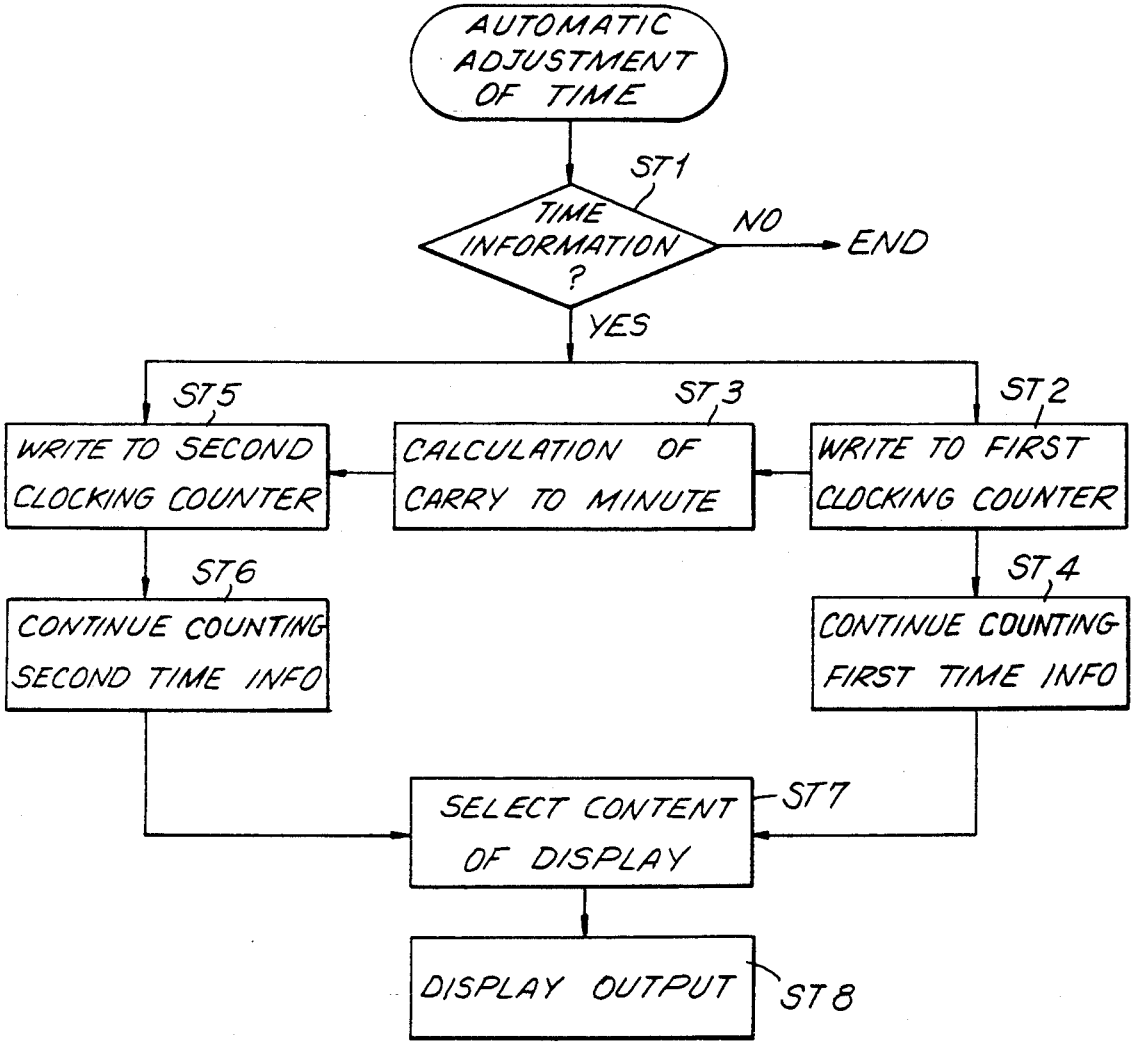
FIG. 2 is a flow chart illustrating the timekeeping operation of the receiver.

Reference is now made to FIG. 2, wherein the time receiving and adjusting process to be executed at control section 16 of receiver 40 is depicted. Receiver 40 maintains the current time of day for two different settings (i.e. a first time of day and a second time of day). Each setting can be adjusted (updated) to maintain its accuracy. The first time of day, second time of day and external time related information each include hours, minutes and seconds data. The two times of day can represent times in different time zones. During the adjusting (updating) process, which typically involves only the seconds data (including fractions thereof), the second time of day is adjusted based on standard time information provided from transmitter 50. The minutes data (and if necessary hours data) of the second time of day is adjusted based on the standard time information and the deviation, if any, from the first time of day time.

The steps involved in the adjusting process with respect to both the first time of day and second time of day are shown in FIG. 2. During a step ST1, the external time signal, after being demodulated by demodulation circuit 3, is checked again by control unit 5. This second check is to insure that improper information is not further processed so as to produce incorrect timekeeping results.

For example, information produced by demodulation circuit 3 which does not represent time data but rather month data such as the number "15", is checked by control section 16 and determined to not represent time data. Information judged to be incorrect is not used. When the time information is correct, the program proceeds to steps ST2 and ST5. When the time information is not correct, the information is not further processed.

During step ST2, the standard time information containing hour, minutes and seconds data obtained under step ST1, is written into first clocking counter 14 by control section 16 for updating the first time of day. The first time of day is then maintained by first clocking counter 14.

Under a step ST3, a comparison is made in control unit 5 between the time information written into counter 14 under step ST2 and the previous time information of first clocking counter 14. The comparison determines whether the minutes data previously contained in first clocking counter 14 and the minutes data of the standard time information written into counter 14 under step ST2 are the same. The difference, if any, is stored in RAM 9 and will be used to adjust the minutes data of the second time of day.

First clocking counter 14, after being adjusted during step ST2 by the standard time information continues count time under a step ST4 based on clock signal CS produced by oscillator circuit 11 serving as its own time reference. The first time continues to be counted until it is again adjusted by the standard time information. This facilitates accurate timekeeping.

During a step ST5, a second time of day is counted in second clocking counter 15 based on clock signal CS from oscillator circuit 11. The second time of day is counted based on an initial manual input of at least hours data and minutes data by switching device 13. In addition, seconds data and fractions thereof of second clocking counter 15 are updated using the standard time information received under step ST1.

In the event that an elapse of time occurs between execution of step ST2 and execution of step ST5, the seconds data in second clocking counter 15 is set to correspond with the updated seconds data in first clocking counter 14. Counter 15 is internally continuously generating signals indicative of time data after that point.

In addition to adjusting seconds data, minutes data for the second time of day is adjusted based on the value obtained during step ST3 which is stored in RAM 9. The value stored in RAM 9 is either added to or subtracted from the minutes data in second clocking counter 15 to insure the accuracy of the time of day stored in second clocking circuit 15.

For example, suppose the contents of first clocking counter 14 is to be adjusted to represent 12 hours 00 minutes and 00 seconds P.M. based on standard time information when the contents of first clocking counter 14 represents 11 hours 59 minutes and 59 seconds AM and the contents of second clocking counter 15 represents 10 hours 59 minutes and 59 seconds A.M. When only the seconds or fractions thereof of the second time of day are adjusted based on the standard time information, the contents of second clocking counter 15 will represent 10 hours 59 minutes and 00 seconds A.M. Second clocking counter 15 therefore loses one minute relative to first clocking counter 14.

On the other hand, suppose first time clocking counter 14 represents 12 hours 00 minutes and 00 seconds P.M. and second clocking counter 15 represents 11 hours 00 minutes and 00 seconds A.M. When first clocking counter 14 is to be adjusted based on standard time information to represent 11 hours 59 minutes and 59 seconds A.M., adjustment to the value of second clocking counter 15 representing only seconds will result in a second clocking counter value of 11 hours 00 minutes and 59 seconds A.M. The second clocking counter 15 gains one minute relative to the first clocking counter 14.

To avoid this error, the contents of second clocking counter 15 is adjusted, as described above, based on the minute differential stored in RAM 9 during step ST3. If such an adjustment is not performed, a one-minute error can occur during each standard time information adjustment. When such an error occurs, the relative difference between the minutes data of the first time of day and the minutes data of the second time of day changes.

After adjustment of the second time,,including the minute error correction, the second time is determined continuously thereafter based on a clock signal CS from oscillator circuit 11 under a step ST6.

During a step ST7, either a first time of day or a second time of day is selected for display by switching device 13. Under a step ST8, the selected first or second time of day is displayed by LCD 12 which is driven by LCD driver circuit 10.

Figure 3:
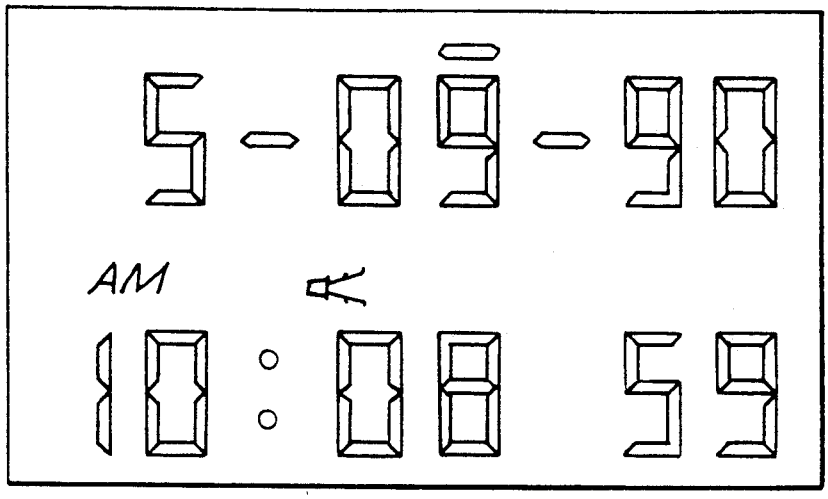
FIG. 3 is a diagrammatic plan view of the receiver display illustrating a first time and date in accordance with the invention.
Figure 4:
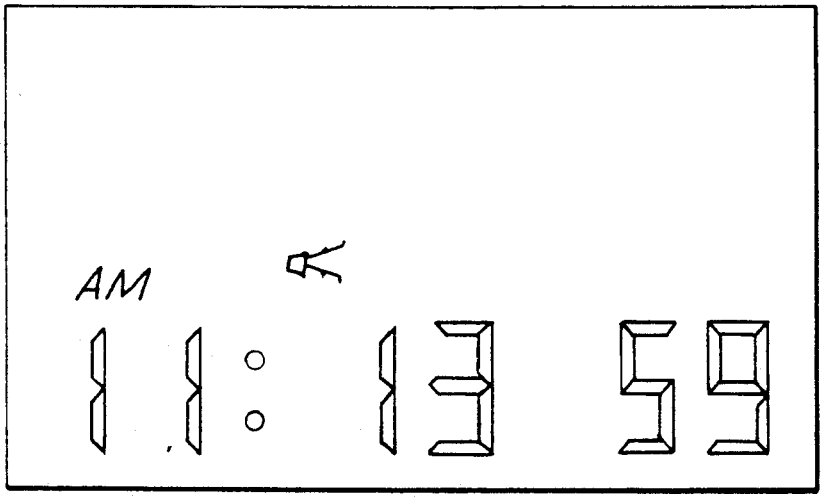
FIG. 4 is a diagrammatic plan view of the receiver display illustrating a second time in accordance with the invention.

Reference is now made to FIGS. 3 and 4 wherein displays for a first time of day and a second time of day are depicted, respectively. In FIG. 3, the month, day and year are displayed in an upper row with hours, minutes and seconds for the first time of day displayed in the lower row.

In FIG. 4 only the hours, minutes and seconds of a second time of day are displayed in the lower row. The month, day and year if desired can also be displayed in a manner similar to FIG. 3. Furthermore, the method of displaying can be changed, for example, by interchanging the upper row and lower row. Interchanging of the month, day and year is also possible.

While a second time of day is displayed, it is possible to manually set the hour and minutes to the time of day of a different time zone. The setting of any time differential from that of first time of day is also possible. The seconds display of the second time of day will match the seconds display of the first time of day, as previously described.

Although in the present embodiment only a second time of day can be set in accordance with the invention, more than two times of day can be set. In this way, a user can accurately maintain the time of day in several different time zones simultaneously.

The invention can also be applied to a timekeeping function in which adjustment occurs to not only hours, minutes and seconds but also to a 1/10 of a second or 1/100 of a second, (i.e. a stopwatch).

As can now be readily appreciated, in accordance with the invention, a selective signal wireless receiving device with a timekeeping function is provided for accurately maintaining a first time of day and a second time of day. The first and second times of day can represent times in two different time zones separated by a time differential. The first time of day is generally the current time of day where the receiver is presently located. It is adjusted periodically by an external time signal so as to maintain accurate time. The second time of day is initially manually set to represent the time in a second time zone and thereafter is adjusted periodically by the external signal and by the updated first time of day so as to maintain accurate time.

Since the external signal transmits the correct time of day (i.e. standard time information) for the receiver's present location, in accordance with a preferred embodiment of the invention, adjustment is made to the seconds data of second clocking counter 15. In other words, the seconds data for the first time of day and second time of day are maintained at the same value.

In accordance with the invention, the second time of day is accurately maintained even though receiver 40 is in a different time zone. Furthermore, if desired, the second time of day can be set ahead of the actual time of day by a predetermined amount of time. The time difference between these two times of day will be accurately maintained.

It will thus be seen that the objects set forth above, among those made apparent from the preceding description, are efficiently attained and, since certain changes may be made in carrying out the above method and in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A receiver and dual timekeeping device comprising:

receiver means for receiving an external signal;

first timekeeping means for generating first time related information; second timekeeping means for generating second time related information maintainable at a selected time interval from said first time related information said external signal, said first time related information and said second time related information each including data representing hours, minutes and seconds; and control means coupled to said receiver means, said first timekeeping means, and said second timekeeping means for receiving said external signal and adjusting said hours, minutes and seconds of said first time related information of said first timekeeping means and for adjusting only said seconds and minutes of said second time related information of said second timekeeping means based on the external signal and not adjusting the second time related information representing the hours based on the data representing hours of said external signal or on any adjustment to the data representing hours of said first time related information so as to maintain said selected time interval between the minutes information, if any, of said first and second time related information.

2. The receiver of claim 1, wherein said second time related information is adapted to be additionally set and adjusted manually.

3. The receiver of claim 1, wherein said control means determines the amount of adjustment made to the data representing minutes of said first time related information and further adjusts the data representing minutes of said second time related information based on the amount of adjustment made to the data representing minutes of said first time related information and the difference between the minutes of the first and second time related information prior to adjustment of said first time related information.

4. The receiver of claim 1, wherein said control means is operable for maintaining the data representing seconds of said first time related information and the data representing seconds of said second time related information at the same value.

5. The receiver of claim 1, further including storage means for storing said amount of adjustment made to said first time related information.

6. The receiver of claim 1, wherein said control means is further operable for determining the presence of time related information in said external signal and inhibiting adjustment to said first time related information and said second time related information in the absence of time related information in said external signal.

7. The receiver of claim 1, in combination with wireless transmitter means, said transmitter means for transmitting said external signal.

8. The receiver of claim 1, further including display means for displaying said first time related information and said second time related information.

9. The receiver of claim 8, wherein said display means is a liquid crystal display device.

10. The wireless receiving device of claim 8, further including switching means for controlling said display means to selectively display said first time related information and said second time related information.

11. The receiver of claim 1, further including oscillator means for providing an oscillating signal, said first timekeeping means and said second timekeeping means responsive to said oscillating signal in generating said first time related information and said second time related information, respectively.

12. The receiver of claim 3, wherein said control means is further operable for determining the presence of time related information in said external signal and inhibiting adjustment to said first time related information and said second time related information in the absence of time related information in said external signal.

13. The receiver of claim 4, wherein said control means is further operable for determining the presence of time related information in said external signal and inhibiting adjustment to said first time related information and said second time related information in the absence of time related information in said external signal.

14. The receiver of claim 4, further including display means for displaying said first time related information and said second time related information.

15. The receiver of claim 14, wherein said display means is a liquid crystal display device.

16. The wireless receiving device of claim 15, further including switching means for controlling said display means to selectively display said first time related information and said second time related information.

17. The receiver of claim 1, wherein said external signal further includes a non-time related message and wherein said control means is operable for processing said non-time related message and further including warning means to identify processing by said control means of said non-time related message.

18. The receiver of claim 1, wherein said control means further adjusts at least data representing seconds of said second time related information based on the data representing seconds of said first time related information following adjustment to the latter.

19. The receiver of claim 8, wherein said control means further adjusts at least data representing seconds of the second time related information based on the data representing seconds of the first time related information following adjustment to the latter.

20. The receiver and dual timekeeping device of claim 1, wherein said selected time interval is selectable at a value not being a multiple of one hour.

21. The receiver of claim 3, further including a single oscillator, said first timekeeping means and said second timekeeping means responsive to said single oscillator in generating said first time related information and said second time related information.

22. A receiver and dual timekeeping device comprising:

receiver means for receiving an external signal;

first timekeeping means for generating first time related information;

second timekeeping means for generating second time related information, maintainable at a selected time interval from said first time related information, said external signal, said first time related information and said second time related information, each including data representing hours, minutes and seconds; and control means coupled to said receiver means, first timekeeping means, and second timekeeping means for receiving said external signal and adjusting said hours, minutes and seconds of said first time related information of said first timekeeping means based on said external signal, for determining the amount of adjustment made to said first time related information and for adjusting only said minutes and seconds of said second time related information based only on the amount of adjustment made to said minutes and seconds of said first time related information following adjustment to the latter and not adjusting the data representing the hours of said second time related information based on any adjustment to the data representing hours of said first time related information so as to maintain said selected time interval between the minutes information, if any, of said first and second time related information.

23. The receiver of claim 22, wherein said control means determines the amount of adjustment made to the data representing minutes of said first time related information and further adjusts the data representing minutes of said second time related information based on the amount of adjustment made to the data representing minutes of said first time related information.

24. The receiver of claim 23, wherein said control means further adjusts at least data representing seconds of said second time related information based on the representing seconds of said first time related information following adjustment to the latter.

25. The receiver of claim 22 wherein said control means is operable for maintaining the data representing seconds of said first time related information and the data representing seconds of said second time related information at the same value, said second time related information being adapted to be additionally set and adjusted manually.

26. The receiver of claim 24, wherein said control means is operable for maintaining the data representing seconds of said first time related information and the data representing seconds of said second time related information at the same value.

27. The receiver of claim 22, further including storage means for storing said amount of adjustment made to said first time related information.

28. The receiver of claim 22, wherein said control means is further operable for determining the presence of time related information in said external signal and inhibiting adjustment to said first time related information and said second time related information in the absence of time related information in said external signal.

29. The receiver of claim 22, in combination with wireless transmitter means, said transmitter means for transmitting said external signal.

30. The receiver of claim 22, further including display means for displaying said first time related information and said second time related information.

31. The wireless receiving device of claim 30, further including switching means for controlling said display means to selectively display said first time related information and said second time related information.

32. The receiver of claim 22, further including oscillator means for providing an oscillating signal, said first timekeeping means and said second timekeeping means responsive to said oscillating signal in generating said first time related information and said second time related information, respectively.

33. The receiver of claim 22, wherein said external signal further includes a non-time related message and wherein said control means is operable for processing said non-time related message and further including warning means to identify processing by said control means of said non-time related message.

34. The receiver and dual timekeeping device of claim 22, wherein said selected time interval is selectable at a value not being a multiple of 1 hour.

35. A method of timekeeping by a wireless receiver and dual timekeeping device having first timekeeping means for generating first time related information, second timekeeping means for generating second timekeeping information, and control means for adjusting said first time related information and second time related information, comprising the steps of:

receiving an external signal;

generating first time related information by said first timekeeping means;

generating second time related information by said second timekeeping means, said external signal, said first time related information and said second time related information each including data representing hours, minutes and seconds;

maintaining a selected time interval between said first time related information and said second time related information;

adjusting said hours, minutes and seconds of said first time related information of said first timekeeping means by said control means based on said external signal; and automatically changing only said minutes and seconds of said second time related information of said second timekeeping means by said control means based on said external signal and not changing said hours of said second time related information based upon said external signal so as to maintain said selected time interval between the minutes information, if any, of said first and second time related information.

36. The method of claim 35, further including the step of providing means for manually adjusting at least the hours and minutes of said second tie related information.

37. The method of claim 35, further including determining the presence of time related information in said external signal and inhibiting adjustment to said first time related information and said second time related information in the absence of time related information in said external signal.

38. The method of claim 37, further including displaying said first time related information and said second time related information.

39. The method of claim 35, further including identifying processing by said control means of non-time related information.

40. The method of claim 35, wherein the step of changing includes changing the data representing minutes of said second time related information based on the amount of adjustment made to the data representing minutes of said firs time related information and the difference between the minutes of the first and second time related information prior to adjustment of said first time related information.

41. The method of claim 35, wherein the step of changing also includes changing at least data representing seconds of said second time related information based on the data representing seconds of said first time related information following adjustments to the latter.

42. The method of claim 35, further including maintaining the data representing seconds of said first time related information and the data representing seconds of said second time related information at the same value.

43. The method of claim 35, further including determining the presence of time related information in said external signal and inhibiting adjustment to said first time related information and said second time related information in the absence of time related information in said external signal.

44. The method of claim 35, further including identifying processing by said control means of non-time related information.

45. The method of claim 37, further including identifying processing by said control means of non-time related information.

46. The method of claim 35, further including the step of selecting a time interval which is not a multiple of one hour.

* * * * *